US009975129B2

(12) United States Patent
Göhring et al.

(10) Patent No.: US 9,975,129 B2
(45) Date of Patent: May 22, 2018

(54) PAINT SPRAYING UNIT

(71) Applicant: J. Wagner GmbH, Markdorf (DE)

(72) Inventors: Alfred Göhring, Salem (DE); Thorsten Schnittger, Markdorf (DE); Stephan Bader, Markdorf (DE); Thomas Jeltsch, Friedrichshafen (DE); Hartmut Würpel, Markdorf (DE)

(73) Assignee: J. Wagner GmbH, Markdorf (DE)

( * ) Notice: Subject to any disclaimer, the term of this patent is extended or adjusted under 35 U.S.C. 154(b) by 176 days.

(21) Appl. No.: 15/008,859

(22) Filed: Jan. 28, 2016

(65) Prior Publication Data

US 2016/0221015 A1 Aug. 4, 2016

(30) Foreign Application Priority Data

Jan. 30, 2015 (DE) ..... 10 2015 101 361

(51) Int. Cl.

| | |
|---|---|
| ***B05B 7/02*** | (2006.01) |
| ***B05B 9/04*** | (2006.01) |
| ***B05B 12/08*** | (2006.01) |
| ***B05B 7/08*** | (2006.01) |
| *B05B 15/04* | (2006.01) |

(52) U.S. Cl.

CPC ..... *B05B 9/0409* (2013.01); *B05B 7/0815* (2013.01); *B05B 9/0413* (2013.01); *B05B 9/0426* (2013.01); *B05B 12/087* (2013.01); *B05B 15/0406* (2013.01)

(58) Field of Classification Search

CPC ... B05B 9/0409; B05B 9/0413; B05B 9/0416; B05B 9/0426; B05B 12/087; B05B 7/2416

USPC ..... 239/69, 124, 126, 127, 329, 346, 351, 239/525, 526

See application file for complete search history.

(56) References Cited

U.S. PATENT DOCUMENTS

| | | | | |
|---|---|---|---|---|
| 2,959,358 | A | 11/1960 | Vork | |
| 4,998,672 | A * | 3/1991 | Bordaz | B05B 7/32 239/526 |
| 5,078,799 | A | 1/1992 | Matter et al. | |
| 5,228,622 | A | 7/1993 | Murphy et al. | |
| 5,266,010 | A | 11/1993 | Tanaka et al. | |
| 5,934,883 | A | 8/1999 | Osterloff | |
| 8,596,555 | B2 * | 12/2013 | Thompson | B05B 9/01 239/329 |

(Continued)

FOREIGN PATENT DOCUMENTS

| | | |
|---|---|---|
| DE | 2 309 718 A | 8/1974 |
| DE | 43 18 679 A1 | 12/1993 |

(Continued)

OTHER PUBLICATIONS

German Search Report (Application No. 10 2015 101 361.4) dated Oct. 13, 2015.

*Primary Examiner* — Steven J Ganey
(74) *Attorney, Agent, or Firm* — Burr & Brown, PLLC

(57) ABSTRACT

The invention relates to a paint spraying unit which includes a paint pump, a paint storage container, a paint spraying device, a paint line and a drive device, where the drive device drives the paint pump and the paint pump conveys paint out of the paint storage container through the paint line to a nozzle of the paint spraying device. In this connection, the drive device includes a compressed air rotation motor as the motor.

24 Claims, 8 Drawing Sheets

(56) References Cited

U.S. PATENT DOCUMENTS

| | | | | |
|---|---|---|---|---|
| 8,651,397 | B2 * | 2/2014 | Gaddis | B05B 7/0093 239/146 |
| 2003/0142580 | A1 | 7/2003 | Maguire | |

FOREIGN PATENT DOCUMENTS

| | | | |
|---|---|---|---|
| DE | 693 01 277 | T2 | 1/1996 |
| DE | 196 09 896 | A1 | 9/1997 |
| DE | 199 11 864 | A1 | 9/1999 |
| DE | 101 39 873 | A1 | 2/2002 |
| DE | 103 05 783 | A1 | 8/2004 |
| DE | 11 2007 000 747 | T5 | 3/2009 |
| DE | 10 2010 047 448 | A1 | 4/2012 |
| DE | 10 2013 218 552 | A1 | 3/2015 |
| WO | 2012/171985 | A2 | 12/2012 |
| WO | 2014/197201 | A2 | 12/2014 |

* cited by examiner

PAINT SPRAYING UNIT

This application claims the benefit under 35 USC § 119(a)-(d) of German Application No. 10 2015 101 361.4 filed Jan. 30, 2015, the entirety of which is incorporated herein by reference.

FIELD OF THE INVENTION

The invention relates to a paint spraying unit.

BACKGROUND OF THE INVENTION

DE 196 09 896 A1 discloses a paint spraying unit which includes a paint pump, a paint storage container, a paint spraying device, a paint line and a drive device, wherein the drive device drives the paint pump and wherein the paint pump conveys paint out of the paint storage container through the paint line to the paint spraying device. A disadvantage of these types of paint spraying units is the use of an electric motor as the drive device as the costs when using a speed-controlled electric motor and a corresponding control device are high as regulations for explosion protection can be respected at best with increased expenditure on construction and as, in principle, there is a susceptibility to moisture.

SUMMARY OF THE INVENTION

It is an object of the present invention to propose a paint spraying unit which makes it possible to respect the regulations for explosion protection with a small amount of expenditure on construction and which is sturdy and not susceptible to moisture. In addition, it is an object of the present invention to propose a paint spraying unit which makes power-controlled, in particular, power-regulated operation possible with a small amount of expenditure on construction and where driving energy which is made available from an energy source is made use of in a sparing manner.

In the case of the paint spraying unit according to the present invention, the drive device includes a compressed air rotation motor as the motor. A compressed air rotation motor does not include any electrical components such that explosion regulations can be respected without any additional expenditure. In addition, these types of compressed air motors are drive devices which have proved their worth as sturdy drive devices in the construction site area, and, in particular, are not susceptible to moisture.

It is provided to realize the compressed air rotation motor as a radial piston motor or as a vane motor. Radial piston motors are particularly suitable for driving paint pumps as they have a high starting torque such that start-up difficulties which can be caused, for example, by cold and consequently viscous paint are avoided. In addition, the operating speeds of radial piston motors are within a range suitable for paint pumps such that there is no need to use speed reducers. Vane motors are also suitable for use in paint spraying units as they have a small construction size in relation to their performance and thus, in particular, in the case of mobile paint spraying units are smaller in weight and consequently make transport easier.

In addition, it is provided to equip the paint spraying unit with a control device, wherein the control device includes a detecting device, a valve device and a pressure preselecting device, wherein the detecting device detects a paint pressure of the paint in the paint line between an outlet of the paint pump and an inlet of the paint spraying device, wherein the valve device, in dependence on the detected paint pressure, determines a compressed air supply to the rotation motor in such a manner that the compressed air supply reduces or is interrupted when the paint pressure is sufficient and that the compressed air supply is increased or opened if the paint pressure is too low and wherein the pressure preselecting device gives a maximum value for the paint pressure from which the compressed air supply is reduced or interrupted, and gives a minimum value for the paint pressure from which the compressed air supply is increased or opened. As a result, in the case of such compressed air motors, power-controlled operation is possible with a small amount of expenditure on construction as only the compressed air supply has to be adapted. As a result of a design of this type, a particularly sparing use of compressed air, which is made available from a compressed air source, is ensured as a use of the paint pressure as a control variable for the compressed air supply ensures that the air consumption of the motor is completely stopped as long as the paint pressure is sufficiently high even when the spraying action is interrupted. Consequently, the lack of absolute tightness of the motor does not have a negative effect on consumption of the compressed air. The control device consequently forms a regulating device for the compressed air supply to the compressed air rotation motor. By means of the pressure preselecting device, a required value is set for the paint pressure or an interval is set for the desired paint pressure, the paint pressure forming the regulating variable. In dependence on a deviation of the paint pressure from the required value or from the predetermined interval, a controller, which includes a detecting device, a valve device and a pressure preselecting device, is activated. As a result of the controller, the compressed air supply which serves as an actuating variable is increased or minimized or kept constant in dependence of the paint pressure present. Consequently, the compressed air motor and the paint pump form component parts of a control section for the paint pressure. The opening and closing of the paint spraying device occurs here in particular as a disturbance variable as a changing paint pressure is caused as a result. The pressure preselecting device is also realized in particular so as to be infinitely adjustable. As a result, fine adjustment is possible within each adjusting range.

According to a first realization variant, the control device is realized as a mechanical control device, wherein the detecting device includes a plunger, wherein the valve device includes a blocking element and wherein the pressure preselecting device includes a resilient pin. This type of purely mechanical realization of the control device also makes it possible to meet strict regulations for protection against explosion with a minimum amount of expenditure on construction.

In the case of the mechanical realization variant, it is provided to arrange the plunger of the detecting device so as to be displaceable in a valve seat of the control device and to allow it to project into the paint line, wherein the resilient pin of the pressure preselecting device is arranged in the valve seat of the control device, wherein the blocking element of the valve device is clamped in the valve seat between the plunger and the pin and wherein, in dependence on a position of the plunger and the pin, the blocking element closes or opens a compressed air line which crosses the valve seat of the control device. This type of mechanical design is realizable with a smaller number of parts and is space-saving. As an alternative to this, it is also provided to realize the detecting device as a diaphragm which actuates the blocking element in dependence on the prevailing paint pressure.

According to a second realization variant, the control device is realized as an electro-mechanical control device, wherein the detecting device includes a pressure sensor, wherein the valve device includes an electrically actuated valve, wherein the pressure preselecting device includes a storage unit and wherein the control device includes an evaluating device. This type of electromechanical realization of the control device makes it possible to choose the arrangement of each individual component of the control device in a free manner such that each component can be arranged in an optimum manner on the paint spraying unit with reference to ergonomics, service-friendliness and compact design. To increase convenience, it is also provided to realize the pressure preselecting device as an infinitely variable pressure preselecting device such that it is possible to adjust the paint spraying unit in a precise manner.

In the case of the electromechanical realization variant, it is provided for the pressure sensor to output a signal value in dependence on a predominant paint pressure, wherein a maximum value and a minimum value for the paint pressure are stored in the storage unit, wherein an actuating value for the valve is determined in the control device and forwarded to the valve, wherein the actuating value is determined in dependence on a signal value of the pressure sensor and in dependence on the stored maximum value and on the stored minimum value. The electromechanical realization variant makes it possible to carry out a plausibility test by means of the control device and thus to avoid damage to the paint spraying unit caused by inadmissible operating states.

It is also provided to connect the compressed air motor to a piston diaphragm pump which generates a pulsating oil flow, wherein the oil flow pushes on a first side of a diaphragm of the paint pump which is realized as a diaphragm pump and wherein, with a second side of the diaphragm, the diaphragm pump pumps liquid paint by means of the paint line to the paint spraying device. As a result, mechanical load on the diaphragm of the diaphragm pump is kept low as the diaphragm is trapped between an oil pad and a paint pad which act on the diaphragm at similar pressure.

In addition, it is provided to cool the paint pump using the compressed air motor. The depressurized compressed air provides for optimum cooling without additional expenditure on energy being necessary. In this connection, it is provided to equip the compressed air motor in particular with a compressed air outlet, wherein the paint pump includes in particular an oil cooler and wherein the compressed air outlet is connected to the oil cooler in such a manner or is aligned in particular in such a manner with the oil cooler that the compressed air emerging out of the compressed air outlet in particular contacts the oil cooler and cools the oil cooler. As a result of a development of this type, a cooling function can be realized with minimum expenditure and in a compact design. To increase the effectiveness of the cooling, it is provided to equip the oil cooler with cooling ribs.

For relieving the pressure of the paint spraying unit, it is provided to equip the paint spraying unit with a paint pressure relief valve for the paint line, wherein the paint pressure relief valve is connected in such a manner to a compressed air supply valve for compressed air supply to the compressed air motor that the paint line is relieved by the paint pressure relief valve as a result of the compressed air supply to the compressed air supply valve being blocked. As a result, unwanted spraying of paint is avoided when, once the pressurized air supply has been disconnected, another extraction from the paint spraying device is actuated.

It is also provided as an additional measure to connect the paint pressure relief valve further in such a manner to the compressed air supply valve for the compressed air supply to the compressed air motor that the compressed air supply valve for the compressed air supply is closed as a result of actuating the paint pressure relief valve. As a result, unnecessary new build-up of paint pressure is prevented and energy consequently saved.

To operate the paint spraying unit, it is provided to equip the paint spraying unit with a multi-switch, wherein in a first switching step or off-position of the multi-switch a compressed air supply valve is closed and a paint pressure relief valve is open, wherein in a second switching step or venting position of the multi-switch the compressed air supply valve is open and the paint pressure relief valve is open, wherein in a third switching step or on-position of the multi-switch the compressed air supply valve is open and the paint pressure relief valve is closed. As a result of a three-step mode selection switch of this type, simple operation of the paint spraying unit is ensured meeting demands for high levels of convenience.

Finally, it is also provided in the case of the mode selection switch or multi-switch, to realize the multi-switch as an infinitely rotatable switch such that it is possible to switch directly from the third switching step into the first switching step and from the first switching step into the third switching step avoiding transient activation of the second switching step. A free switching sequence is advantageous, in particular, in the case of professional units since, as a result, it is possible to resume operation immediately again after a short operational interruption. As a result of using a compressed air rotation motor, it is also possible to start up the rotation motor against pump pressure without having to fear this would lead to a critical operating state of the paint spraying unit.

It is also provided in the case of a paint spraying unit according to the invention, to equip the drive device with a compressed air motor which is realized as a compressed air linear motor, wherein the paint spraying unit includes a control device, wherein the control device includes a detecting device, a valve device and a pressure preselecting device, wherein the detecting device detects a paint pressure of the paint in the paint line between an outlet of the paint pump and an inlet of the paint spraying device, wherein the valve device, in dependence on the detected paint pressure, determines a compressed air supply to the motor in such a manner that the compressed air supply reduces or is interrupted when the paint pressure is sufficient and that the compressed air supply is increased or opened if the paint pressure is too low and wherein the pressure preselecting device gives a maximum value for the paint pressure from which the compressed air supply is reduced or interrupted, and gives a minimum value for the paint pressure from which the compressed air supply is increased or opened. With little expenditure on construction, a paint spraying unit of this type enables power-controlled operation and compliance with the regulations protecting against explosion as the motor does not comprise any electrical or electronic components which have to be protected, and the actuating variable of air pressure can be influenced using simple technical means which do not require protection against explosion or where protection against explosion can be produced at little expenditure. A paint spraying unit of this type is also correspondingly sturdy and not susceptible to moisture. As a result of regulating the paint spraying unit by means of the actuating variable of compressed air, which forms the energy carrier, savings can be made in drive energy as the compressed air supply is interrupted when there is sufficient paint pressure such that no losses occur as a result of motor leakages which are due to the design.

It is also provided to realize the paint pump as a multiple-acting and in particular double-acting paint pump. A uniform paint flow which results in a particularly uniform spray pattern is generated as a result.

In addition, it is provided that the control device includes a damping member. As a result, unwanted variation in the control device is effectively prevented. In the case of a mechanically operating control device, the damping member is formed by a slight sluggishness of one of the moving parts of the control device. In the case of an electromechanically operating control device, the damping member is realized as an electronic component which actuates the valve for the compressed air.

In terms of the invention, a compressed air rotation motor is to be understood as a motor which includes a motor shaft which is driven as a result of the expansion of compressed air. According to a first realization variant, the compressed air rotation motor is realized as a radial piston motor. A radial piston motor includes several pistons, which extend in cylinders which are preferably arranged in a star-shaped manner with respect to one another and which act by means of connecting rods on a crankshaft journal which is connected to the motor shaft. These types of radial piston motors are marketed, for example, by PARKER under the P1V-P series name and can be found in catalogue "PDE2538RCDE-u1, December 2007". According to a second realization variant, the compressed air rotation motor is realized as a vane motor. A vane motor includes a stator housing which is arranged eccentrically with respect to the motor shaft and vanes which are mounted so as to be radially displaceable on the motor shaft.

In terms of the invention, a compressed air linear motor is to be understood as a motor which includes at least one piston which carries out a back and forth movement as a result of a two-way impingement with compressed air and acts directly or indirectly on the paint to be conveyed with a pressure plunger coupled to the piston in a pressure-generating manner.

BRIEF DESCRIPTION OF THE DRAWINGS

Further details of the invention are described by way of schematically shown exemplary embodiments in the drawing, in which.

DETAILED DESCRIPTION OF THE INVENTION

Figure 1:
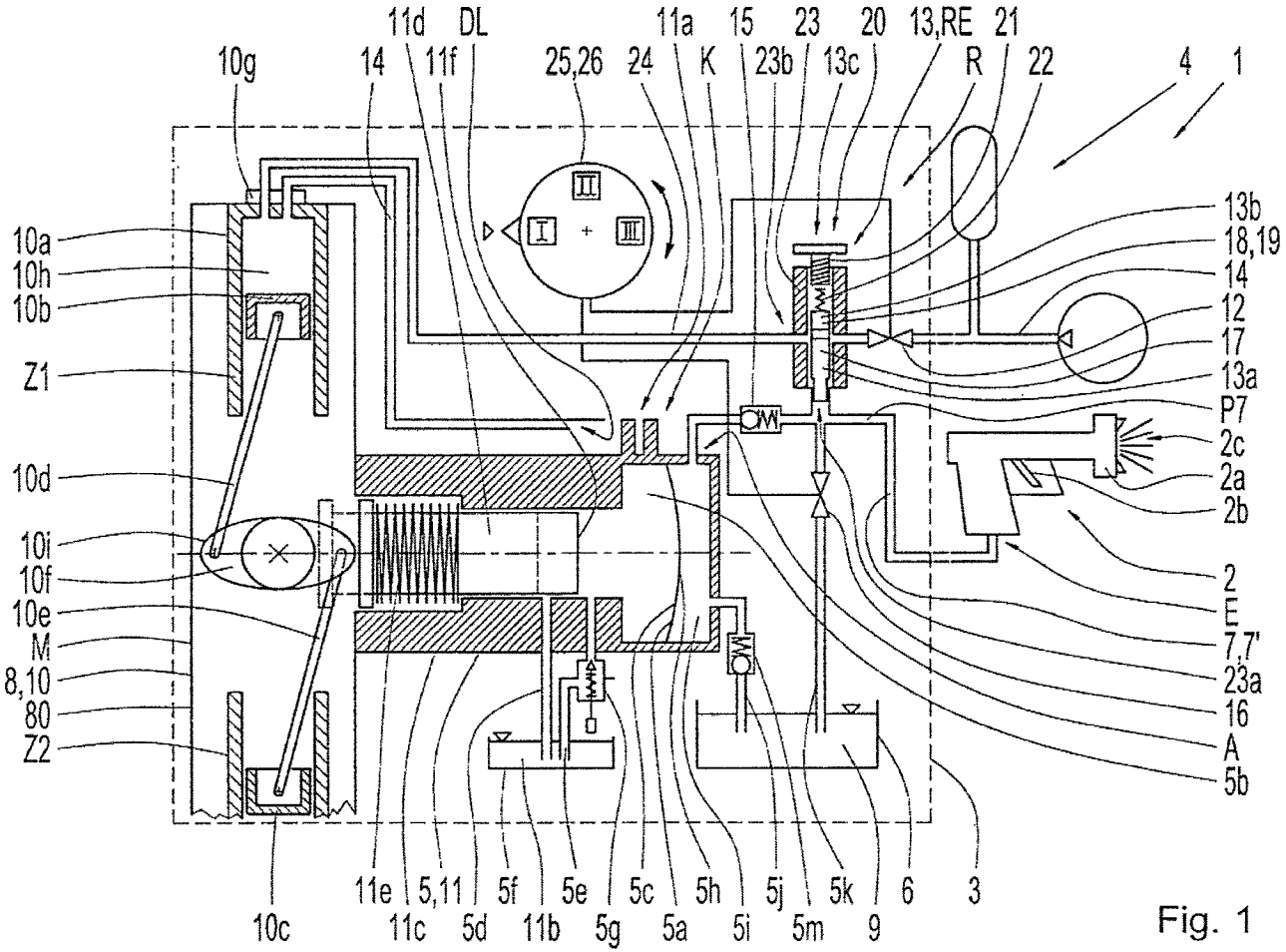
FIG. 1 shows a schematic representation of a first realization variant of a paint spraying unit according to the invention.

FIG. 1 shows a schematic representation of a first realization variant of a paint spraying unit 1 according to the invention. The paint spraying unit 1 includes a paint spraying device 2 and a drive and supply unit 3. The drive and supply unit 3 is connected to a compressed air source 4.

The drive and supply unit 3 of the paint spraying unit 1 includes a paint pump 5 which is realized as a piston diaphragm pump 11, a paint storage container 6, a paint line 7 and a drive device 8, the drive device 8 driving the paint pump 5. The paint pump 5 conveys paint 9 out of the paint storage container 6 through the paint line 7 to an inlet E of the paint spraying device 2 and further to a spray head 2*a* with a paint nozzle 2*c* of the paint spraying device 2.

The drive device 8 is realized as a compressed air motor M in the form of a compressed air rotation motor 10. In this connection, the rotation motor 10 is realized as a radial piston motor 80 and the paint pump 5 is realized as a piston diaphragm pump 11. The piston diaphragm pump 11 transmits the driving power of the compressed air rotation motor 10 to the paint 9 by means of a diaphragm 5*a*.

The rotation motor 10 is connected to the compressed air source 4 with the interposition of a compressed air valve 12 and a control device 13. Insofar as the compressed air supply 12 and a valve device 13*b* of the control device 13 are open, compressed air flows to the compressed air rotation motor 10. The motor includes a motor block 10*a* in which two oppositely situated cylinders Z1, Z2 are arranged, in which pistons 10*b* and 10*c* extend and drive a motor shaft 10*f*, which is realized in the manner of a crankshaft, by means of connecting rods 10*d* and 10*e*. The compressed air 14 is conducted in and out of cylinder chambers 10*h* (only one of the cylinder chambers is visible in the representation) in each case by means of a compressed air distributing device 10*g*. In this connection, the compressed air 14 emerging out of the cylinder chambers 10*h* is conducted out of a compressed air outlet DL onto cooling ribs 11*a* of an oil cooler K of the piston diaphragm pump 11 in order to cool oil 11*b* of the piston diaphragm pump 11. With a double eccentric 10*i*, the motor shaft 10*f* drives a pressure piston 11*d*, which is mounted in a pump housing 11*c* of the piston diaphragm pump 11, against a restoring spring lie. In this connection, the pump housing 11*c* is flanged to the motor block 10*a*. With its piston surface 11*f*, the pressure piston lid compresses oil 11*b* which is situated in a first diaphragm chamber 5*b* or oil chamber of the piston diaphragm pump 11 on a first side 5*c* of the diaphragm 5*a*. The diaphragm chamber 5*b* communicates with an oil tank 5*f* by means of a supply line 5*d* and a pressure relief line 5*e*. In this connection, the pressure piston 11*d*, in its pulled-back position which is indicated by broken lines, enables an inflow of oil 11*v* into the first diaphragm chamber 5*b*. Insofar as the pressure piston 11*d*, in its extended position which is indicated by solid lines, generates an inadmissibly high pressure in the first diaphragm chamber 5*b*, oil 11*b* is able to flow away through the pressure relief line 5*e* as soon as a pressure relief valve 5*g* arranged in the pressure relief line 5*e* responds. The response behavior of the pressure relief valve 5*g* is adjustable. The schematically represented rotation motor 10 is preferably also realized as a star motor with at least three and in particular five cylinders uniformly distributed on the periphery. According to realization variants which are not shown, it is also provided for driving a pressure piston of a piston diaphragm pump or of a diaphragm pump to use a single eccentric or a shaft portion with three and more cams instead of a double eccentric or a shaft portion with two cams.

A second diaphragm chamber 5*i* or paint chamber is situated on a second side 5*h* of the diaphragm 5*a*. The diaphragm chamber 5*i* communicates with the paint storage container 6 by means of a supply line 5*j* and by means of a pressure relief line 5*k*, the pressure relief line 5*k* branching off from the paint line 7, by means of which paint 9 is conveyed by the piston diaphragm pump 11 to an outlet A of the diaphragm pump 5. A non-return valve 5*m*, which ensures that no paint 9 is pushed by the piston diaphragm pump 11 through the supply line 5*j* back into the paint storage container 6, is arranged in the supply line 5*j*. A further non-return valve 15, which is arranged in the paint line 7, prevents a return flow of paint 9 into the second diaphragm chamber 5*i*. The pressure relief line 5*k* branches off from the paint line 7 between the non-return valve 15 and the paint spraying device 2. In addition, the control device 13 is connected to the paint line 7 between the non-return valve 15 and the paint spaying device 2. The control device 13 forms a regulating device RE and along with the mentioned valve device 13*b* includes another detecting device 13*a* and a pressure preselecting device 13*c* which together form a controller R. In this connection, the control device 13 is connected to the paint line 7 in such a manner that the detecting device 13*a* detects a pressure P7 as a regulating variable which the paint 9 comprises in the paint line 7. The pressure P7 of the paint 9, which is built up by the piston diaphragm pump 11 in the paint line 7, can be relieved either by activating the paint spraying device 2 by means of an extraction 2*b* or by activating a paint pressure relief valve 16 or paint pressure release valve which is arranged in the pressure relief line 5*k*. Insofar as the activated paint spraying device 2 lowers the pressure P7 to a greater extent than is built up by the piston diaphragm pump 11, a required value deviation of this type is detected by the detecting device 13*a* and more compressed air 14 is supplied by means of the valve device 13*b*, which is coupled with the detecting device 13*a*, to the rotation motor 10 so that the piston diaphragm pump 11 provides more power. The compressed air 14 forms the actuating variable for the regulating device RE. The response behavior of the control device 13 or a required value can be preselected by means of the pressure preselecting device 13*c*. The control device 13 is constructed mechanically in this connection such that the detecting device 13*a* includes a plunger 17, that the valve device 13*b* includes a blocking element 18 which is realized as a screen 19, and that the pressure preselecting device 13*c* includes a resilient pin 20 which is formed, in turn, by a threaded pin 21 and a spring 22. The individual components of the control device 13 are received in a valve seat 23. In this connection, the screen 19 is realized in an integral manner with the plunger and is mounted between the plunger 17 and the spring 22, the spring 22 being pressed by the threaded pin 21, which is screwed into the valve seat 23, against the screen 19 and pressing the screen in turn against the plunger 17, which, as a result, is pressed out of a window 23*a* of the valve seat 23, by way of which the control device 13 is connected to the paint line 7. As a result, an end face of the plunger 17 is acted upon with the pressure P7 of the paint 9 and, as a result, experiences a counter force to the force generated by the spring 22. Transversely with respect to the alignment of the plunger 17, the valve seat 23 comprises, at the level of the screen 19, a through-bore 23*b*, through which a compressed air line 24 is guided leading from the compressed air source 4 to the rotation motor 10. In dependence on the position of the plunger 17 or on a preload of the spring 22, the screen 19 then determines an opening cross section, through which the compressed air source 4 is able to supply the rotation motor 10. Insofar as the paint pressure P7 drops, the plunger 17 is moved, driven by the spring 22, in the direction of the paint line 7 and the screen 19 increasingly enlarges the cross section which can be traversed by the compressed air. As soon as the maximum cross section is reached, the plunger 17 abuts against a stop which is formed by the valve seat 23. The full opening cross section is opened at lower or higher paint pressure P7 in dependence on a screw-in depth of the threaded pin 21, which determines a preload of the spring 20.

Corresponding to the representation of FIG. 1, the paint spraying unit 1 is realized such that the drive and supply unit 3 is realized as a floor-standing unit which is connected to the compressed air source 4 and the paint spraying device 2 for operation. In this connection, it is provided to realize the paint line 7 at least in portions as a flexible paint pressure hose 7' with a length of at least 2 meters such that the paint spraying device 2 can be handled unobstructed by the supply unit.

On the drive and supply unit 3, the paint spraying unit 1 includes a multi-switch 25 which is realized as a rotary switch 26. The multi-switch 25 comprises three switching steps I, II, III. The compressed air supply valve 12 and the paint pressure relief valve 16 are actuated in the three switching steps I, II and III. In this connection, the switching step I is defined as an OFF position in which the compressed air supply valve 12 is closed and the paint pressure relief valve 16 is open. In this connection, the switching step II is defined as a venting position in which the compressed air supply valve 12 is open and the paint pressure relief valve 16 is open. In this connection, the switching step III is defined as an operating position in which the compressed air supply valve 12 is open and the paint pressure relief valve 16 is closed. As a result of a 180° rotation of the rotary switch 26, it is also possible to switch back and forth between switching steps I and III directly or leaving out the switching step II.

Figure 2:
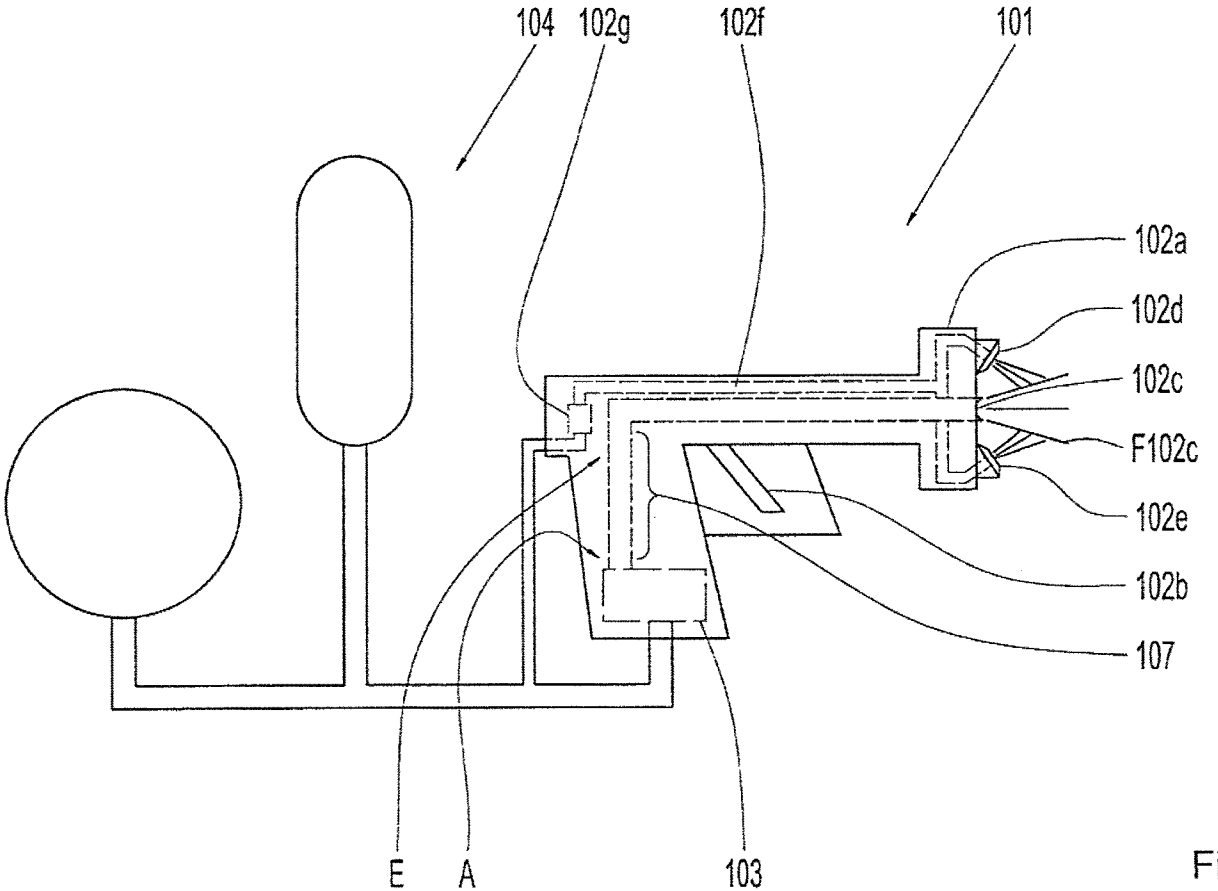
FIG. 2 shows a schematic representation of a second realization variant of a paint spraying unit according to the invention.

FIG. 2 shows a schematic representation of a second realization variant of a paint spraying unit 101 according to the present invention. The paint spraying unit 101 includes paint spraying device 102 with a spraying head 102*a* and a drive and supply unit 103. The drive and supply unit 103 is connected to a compressed air source 104. In contrast to the paint spraying unit shown in FIG. 1, the paint spraying unit 101 is realized as a hand unit where the drive and supply unit 103 is incorporated in the paint spraying device 102. In this connection, reference is made to the realizations relating to FIG. 1 with reference to the design of the drive and supply unit 103, the individual components of the drive and supply unit 103 in the case of the paint spraying unit 101 obviously being optimized with regard to their weight and their volume in order to be able to incorporate them in the hand unit. In particular, the paint line 107 in the case of the realization is realized as paint line 107 which extends inside the paint spraying device 102 between an outlet A and an inlet E. The paint line 107 is realized here as short as possible and is realized, in particular, with a length that is smaller than 40 cm.

According to one realization variant, it is provided that the paint spraying device 102 of the paint spraying unit 101 also includes on its spray head 102*a* at least one air nozzle 102*d*, 102*e* in addition to a paint nozzle 102*c*. The air nozzle or the air nozzles 102*d*, 102*e* is or are arranged in such a manner that the emerging air is directed into a paint jet F102*c* which is generated by the paint nozzle 102*c* and influences the spray pattern thereof. The air nozzle or the air nozzles 102*d*, 102*e* is or are connected to the compressed air source 104 by means of a supply line 102*f*. In this connection, it is preferably provided to connect a control valve 102*g* upstream of the air nozzle or the air nozzles 102*d*, 102*e* in order to be able to adjust the performance thereof. Activation or deactivation of the air nozzle or of the air nozzles 102*d*, 102*e* is preferably effected together with the paint nozzle 102*c* as a result of a corresponding actuation of the extraction 102*b*. This type of realization of the paint spraying device is also provided in the case of all the realization variants of paint spraying units described above and below. In the case of paint spraying units where the drive and supply unit and the paint spraying device are spatially separated from one another, a compressed air line is run from the drive and supply unit to the paint spraying device along with a paint line and is connected to one or several of the air nozzles associated with the paint nozzle.

Figure 3:
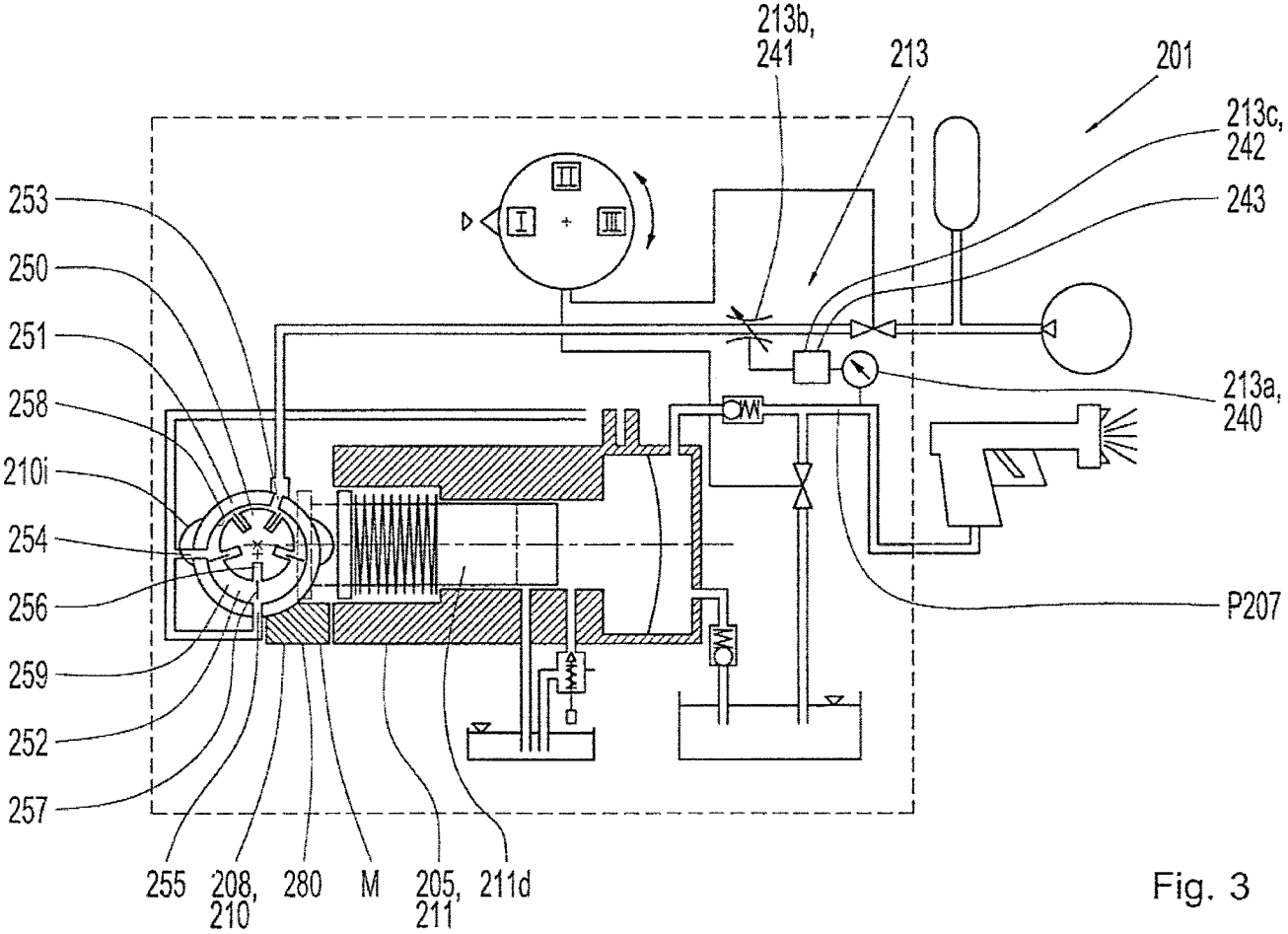
FIG. 3 shows a schematic representation of a third realization variant of a paint spraying unit according to the invention.

FIG. 3 shows a schematic representation of a third realization variant of a paint spraying unit 201 according to the present invention. Reference is made here, in principle, to the description relating to the first realization variant of a paint spraying unit shown in FIG. 1. In contrast to the first realization variant, a motor M or a compressed air rotation motor 210 operating as a drive device 208 is not realized as a radial piston motor, but as a vane motor 280. Just as in the case of the radial piston motor, a double eccentric 210*i* drives a pressure piston 211*d* of a paint pump 205 which is realized as a piston diaphragm pump 211, the piston diaphragm pump 211 operating as described in FIG. 1.

According to realization variants not shown, it is also provided for driving a pressure piston of a piston diaphragm pump or of a diaphragm pump to use a single eccentric or a shaft portion with three and more cams instead of a double eccentric or a shaft portion with two cams.

In the case of the vane motor 280, a motor shaft 250 is rotated in a stator 251, the stator 251 comprising a cylindrical receiving chamber 252 with an air inlet opening 253 and two air outlet openings 254, 255. The motor shaft 250 is mounted eccentrically with respect to the receiving chamber 252. The motor shaft 250 comprises radially arranged longitudinal slots 256 in which vanes 257 are guided so as to be radially movable in such a manner that they abut in each case against an inner wall 258 of the receiving chamber 252 such that chambers 259 which are modified in volume each time the motor shaft 250 is rotated are formed. In order to keep the representation clearly presented, in each case only one longitudinal slot of the five longitudinal slots, only one vane of the five vanes and only one space of the five spaces are designated with a reference. As a result of the rotation of the motor shaft 250 and of the vanes 257, which together form a rotor 260, the inflowing compressed air is able to expand, the expanded compressed air emerging at the air outlets 254, 255 and being removed. The mechanical control device shown in the first realization variant is replaced by an electromechanical control device 213 in the case of the third realization variant. The electromechanical control device 213 includes a pressure sensor 240 as detecting device 213*a*, an electrically actuated valve 241 as valve device 213*b* and a storage unit 242, in which a maximum value and a minimum value for a paint pressure P207 are determinable, as pressure selecting device 213*c*. In addition, the control device 213 includes an evaluating device 243 which actuates the valve 241 in dependence on the momentary paint pressure P207 and on an interval which is defined by the maximum value and the minimum value. Regulations for protection against explosion which have to be met where applicable, can be adhered to with a small amount of expenditure. To this end, the pressure sensor 240, the valve 241, the storage unit 242 and the evaluation device 243 are arranged in a housing which is protected against explosion. In particular, the controlled section is also damped in the evaluating device 243. As a result, constant adjusting of the valve device 213*b* is prevented.

Figure 4:
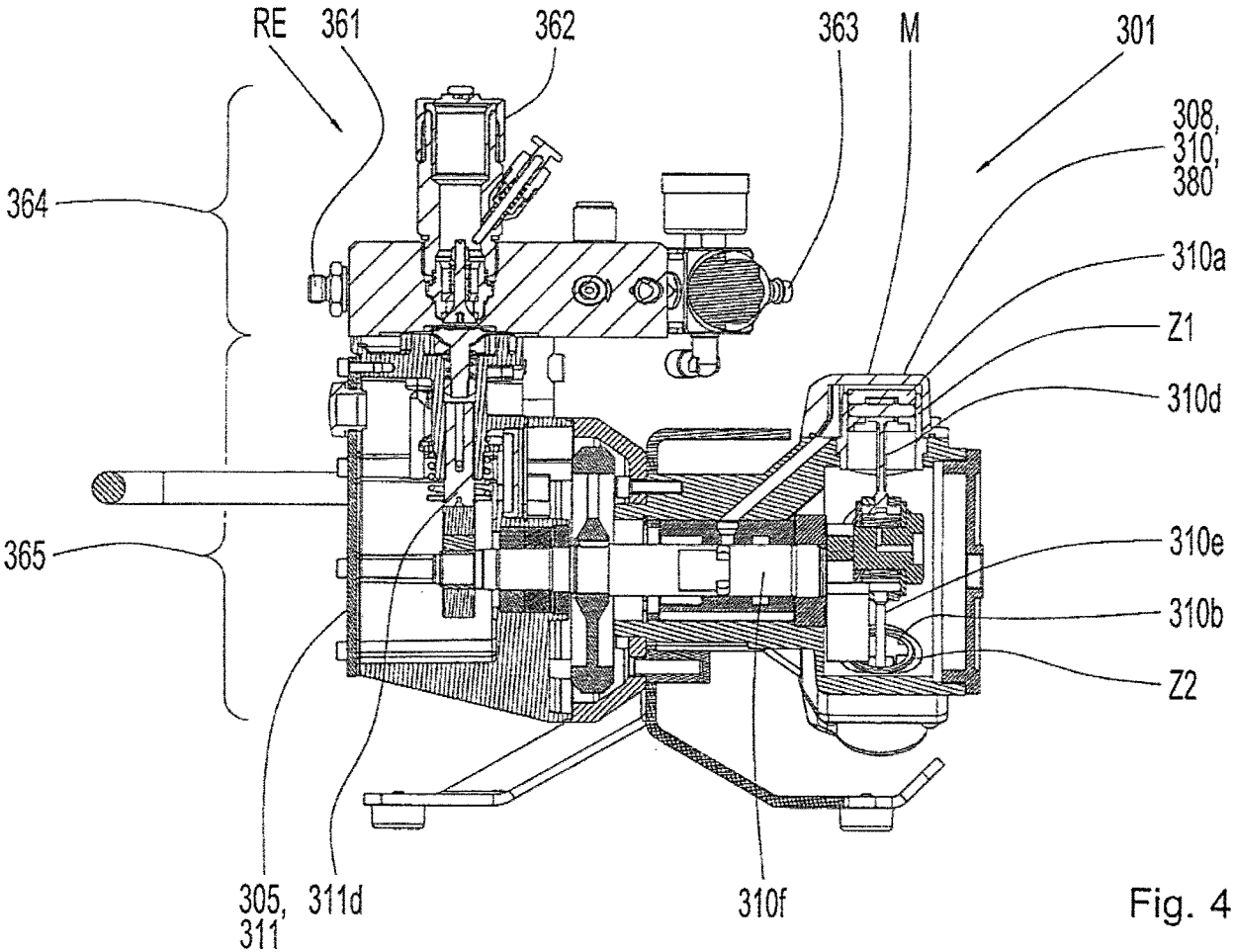
FIG. 4 shows a sectioned representation of a fourth realization variant of a paint spraying unit according to the invention.

FIG. 4 shows a sectioned view of a fourth realization variant of a paint spraying unit 301 according to the present invention. Reference is made here, in principle, to the description relating to the first realization variant of a paint spraying unit shown in FIG. 1. The paint spraying unit 301 includes as drive device 308 a motor M or a compressed air rotation motor 310 which is realized as a radial piston motor 380 and includes five cylinders Z1, Z2, three of which are visible in the section and two of which are designated in FIG. 4. Pistons 310*a*, 310*b*, which drive a motor shaft 310*f* by means of connecting rods 310*d*, 310*e*, are guided in the cylinders Z1, Z2. The paint spraying unit 301 includes as paint pump 305 a piston diaphragm pump 311 which is flanged on the radial piston motor 380 and is driven by the radial piston motor 380 by means of the motor shaft 310*f* and with a pressure piston 311*d* generates a pulsating oil pressure which acts in such a manner on a diaphragm which separates oil and paint that paint is conveyed to a paint outlet 361. A paint spraying device (not shown) is connected to the paint outlet 361 by means of a paint line (not shown). In addition, the paint spraying unit 301 includes a paint inlet 362 to which a paint container (not shown), which is realized in particular as a paint bucket, is connected by means of a suction hose (not shown). A compressed air connection 363, by means of which a compressed air source 304 is connected, is situated opposite the paint outlet 361. The paint spraying unit 301 is constructed in such a manner that a paint step 364, which includes a regulating device RE, the paint outlet 361, the paint inlet 362 and the compressed air connection 363, is arranged spatially above an oil step 365 which includes the piston diaphragm pump 311 and the radial piston motor 380 which drives it. As a result, operation of the paint spraying unit 301 is made simpler as all connections are easily accessible to the user.

Figure 5:
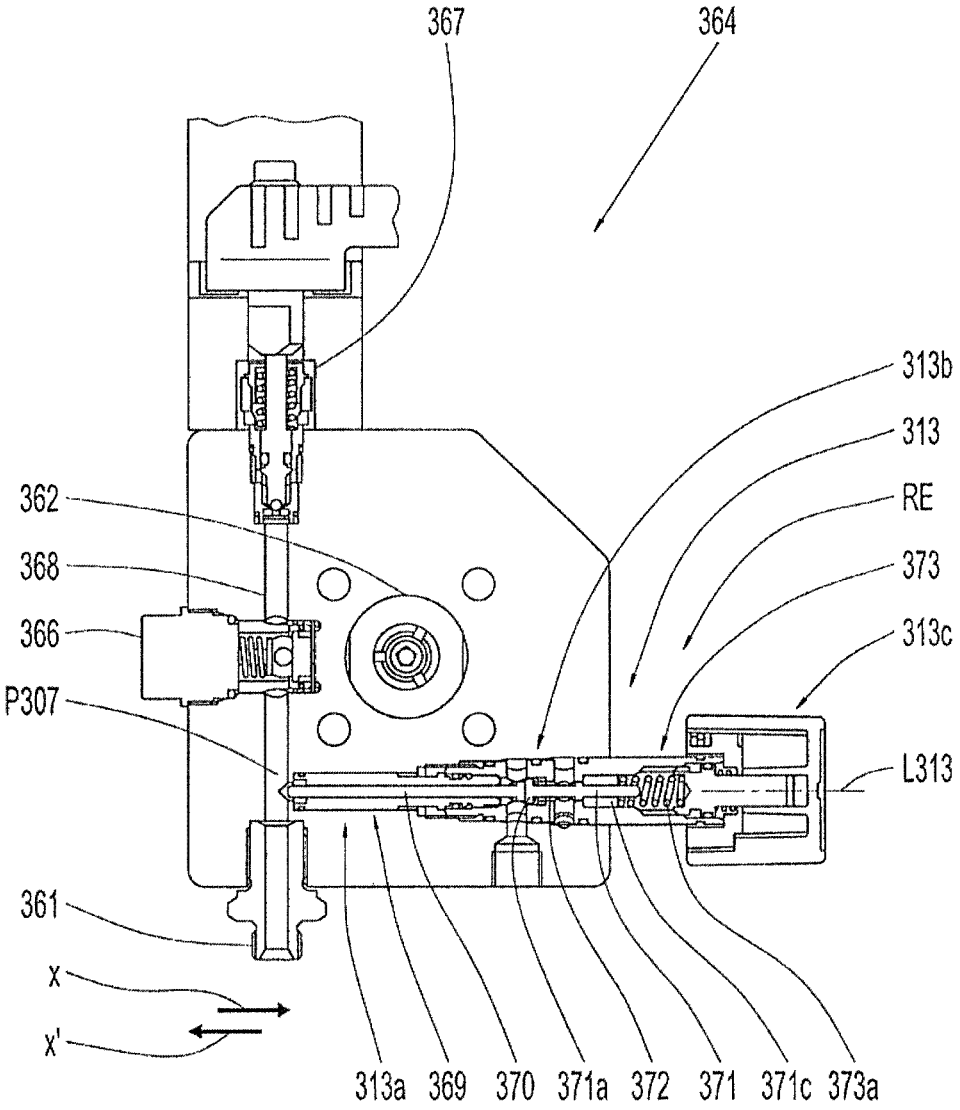
FIGS. 5, 6*a* and 6*b* show a schematic representation of a regulating device of the fourth realization variant of a paint spraying unit shown in FIG. 4.
Figure 6A:
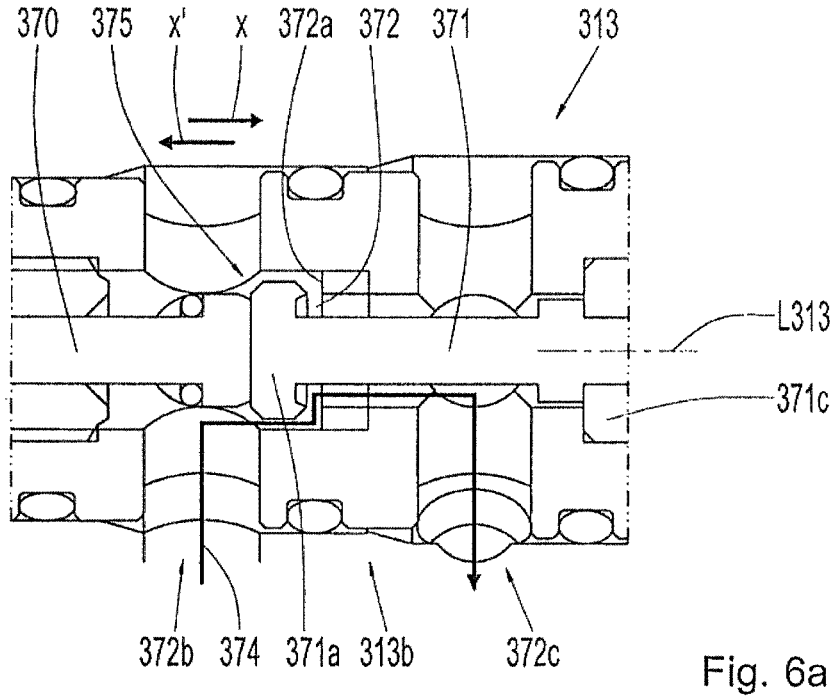

FIG. 5 then shows a schematic view of the paint step 364 and the regulating device RE which is constructed in the paint step 364. A control device 313, the paint outlet 361, a paint outlet valve 366 and a paint pressure relief valve 367 are arranged around the paint inlet 362. As a result of an inflow which is not visible, pressurized paint flows through the piston diaphragm pump 311 (see FIG. 4) into a paint channel 368 which leads to the paint outlet 361, to which is connected the mentioned paint hose (not shown) which leads to the mentioned paint spraying device (not shown). A detecting device 313*a* of the control device 313 includes a paint pressure actual value sensor 369 which includes a resilient plunger 370 which projects into the paint channel 368. A valve device 313*b* of the control device 313 includes a plunger 371 with a plate 371*a* and a sleeve 371*c* as well as a channel 372 with a shoulder 372*a* (see FIG. 6*a*), with an air inlet 372*b* (see FIG. 6*a*) and with an air outlet 372*c* (see FIG. 6*a*). FIG. 6*a* shows an enlarged representation of FIG. 5 in the region of the valve device 313*b*. A pressure preselecting device 313*c* of the control device 313 includes a manually adjustable paint pressure required value valve 373 which includes a spring 373*a*. In this connection, the plunger 371 is clamped between the plunger 370 and the spring 373*a* which acts on the sleeve 371*c* in such a manner that the two plungers 370, 371, the sleeve 371*c* and the spring 373*a* lie along a common longitudinal axis L313, the sleeve 371*c* being supported on a shoulder of the plunger 371.

As long as a paint pressure P307 in the paint channel 368 comprises a constant average value, the plunger 371 is pressed by the plunger 370 of the paint pressure actual value sensor 369 only so far in the direction of the arrow x against the spring 373*a* of the pressure preselecting device 313*c* that the channel 372 of the valve device 313*b* remains open, and the plate 371*a* realized on the plunger 371 is at a spacing from the shoulder 372*a* and thus compressed air is able to flow along a path section 374 from the air inlet 372*b* to the air outlet 372*c* and drive the radial piston motor which is not shown in FIGS. 5 and 6*a*. An open position of this type is shown in FIGS. 5 and 6*a*.

As soon as the paint pressure P307 drops, the plunger 370 is pushed by the spring 373*a* of the pressure preselecting device 313*c*, with the interposition of the plunger 371 of the valve device 313*b*, in the direction of the arrow x' into the paint channel 368 such that the channel 372 of the valve device 313*b* is opened further and more compressed air flows from the air inlet 372*b* to the air outlet 372*c* and the performance of the radial piston motor, which drives the paint pump, increases. It must be noted here in an explanatory manner that FIGS. 5 and 6*a* virtually already show a completely open valve device 313*b* such that the above description has to be read in an initial state in which the plunger 371 is in an intermediate position between the positions shown in FIGS. 6*a* and 6*b*.

As soon as the paint pressure P307 in the paint channel 368 rises again, the plunger 371 of the valve device 313*b* is pushed against the resistance of the spring 373*a* of the pressure preselecting device 313*c* in the direction of the arrow x. As a result, a valve 375, which is formed by the plate 371*a* and the shoulder 372*a* in the channel 372, is increasingly closed. The valve 375 is realized as a plate valve. According to a realization variant which is not shown, it is also provided to realize the valve as a ball valve. The advantage of plate valves in the case of the present application is that a better response behavior of the compressed air rotation motor is achieved when the paint pressure drops suddenly. As a result, the user receives immediate feedback as reaction to an actuation of the extraction such that the paint spraying unit can be operated in a simple manner. The advantage of using a ball valve is that it is particularly sturdy.

Figure 6B:
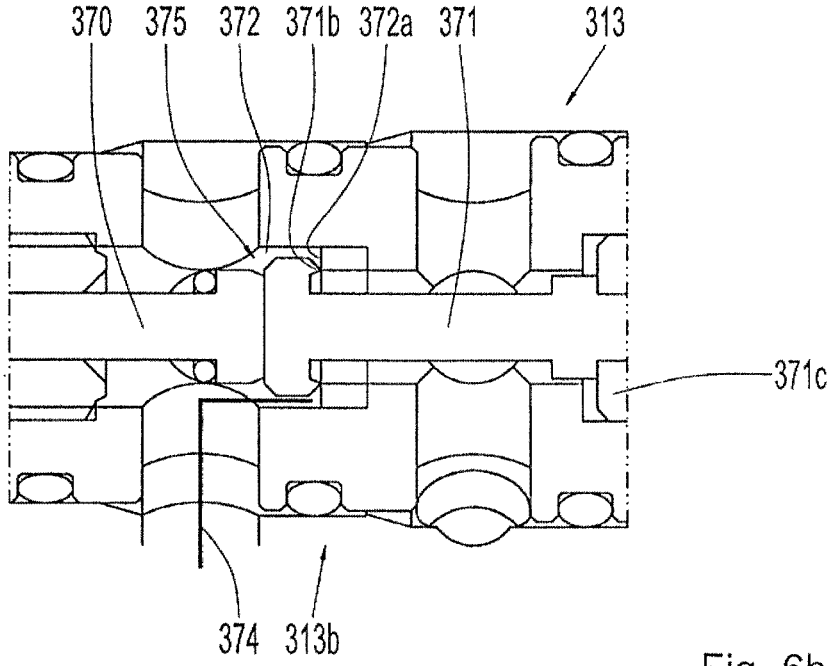

Insofar as the paint pressure P307 in the paint channel 368 reaches a maximum pressure which is predetermined by the pressure preselecting device 313*c*, the valve 375 is closed such that the radial piston motor is separated from its air supply and stops. FIG. 6*b* shows the valve 375 in the mentioned closed position. In the closed position, the plate 371*a*, which is connected to the plunger 371, lies with its seal 371*b* on the shoulder 372*a* of the channel 372 such that the path section 374 is interrupted.

Figure 7:
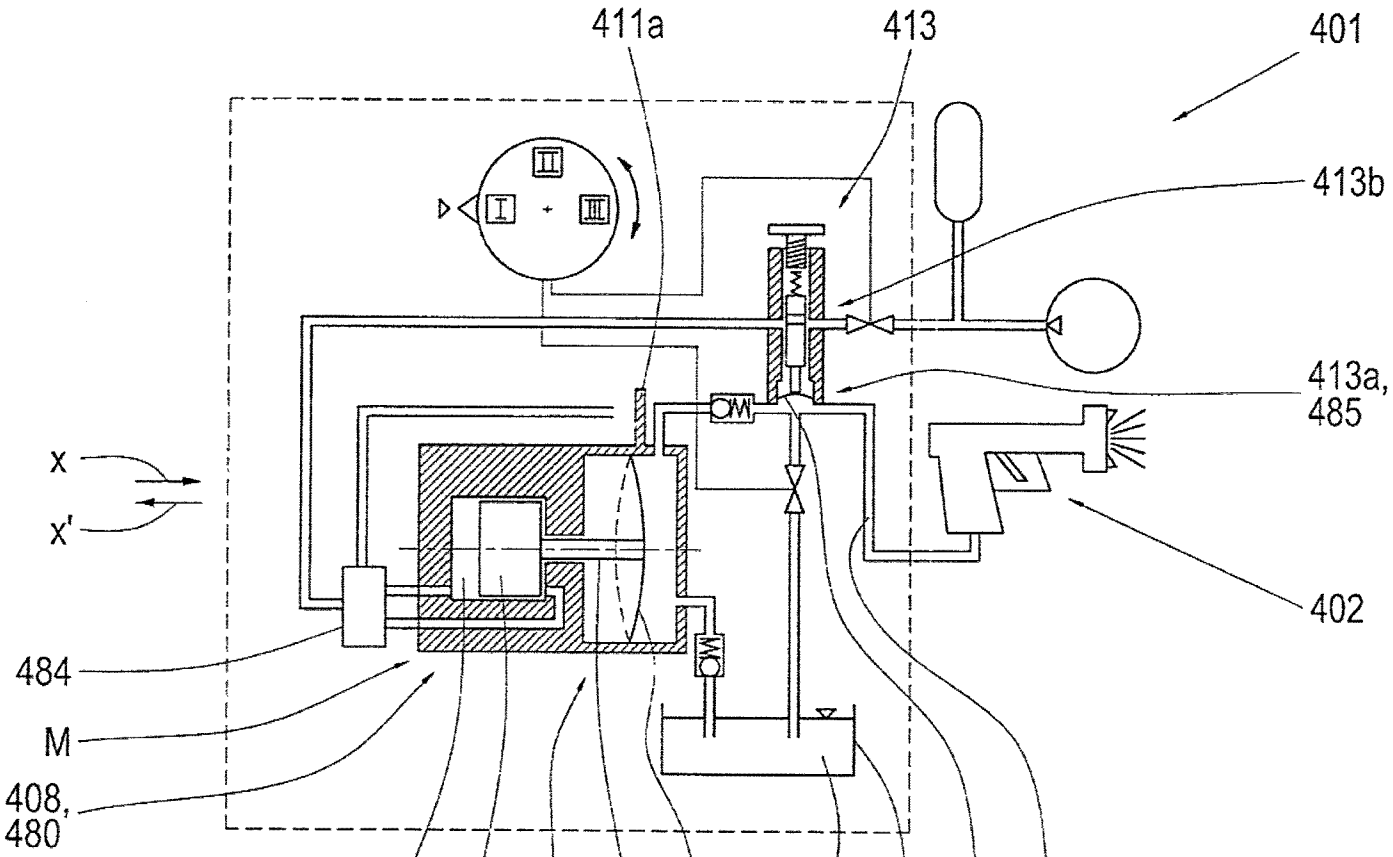
FIG. 7 shows a schematic representation of a fifth realization variant of a paint spraying unit according to the invention.

FIG. 7 shows a schematic representation of a fifth realization variant of a paint spraying unit 401 according to the present invention. Reference is made here, in principle, to the description relating to the first realization variant of a paint spraying unit shown in FIG. 1. In contrast to the first realization variant, a compressed air motor M which operates as a drive device 408 is not realized as a radial piston motor, but as a compressed air linear motor 480. As a result of a two-way impingement of a piston 481 in a cylinder chamber 482 with compressed air, the piston 481 carries out a linear movement in the directions of the arrow x or x' and directly actuates a diaphragm 405*a* of a diaphragm pump 405 by means of a plunger 483 that is connected thereto such that paint 409 is pumped by the diaphragm pump in the manner already described out of a paint container 406 into a paint line 407 and as a result is pumped to a paint spraying device 402. By way of the broken lines, the diaphragm 405*a* is still shown in a position which it assumes when the piston 481 in the cylinder chamber 482 has moved completely in the direction of the arrow x'. Re-routing a compressed air supply into the cylinder chamber 482 is effected by a re-routing unit 484 which operates, in particular, in dependence on a piston position and/or in dependence on a pressure build-up in the cylinder chamber 482. Compressed air conducted out of the cylinder chamber 482 is used on cooling ribs 411*a* for cooling the diaphragm pump 405. The mechanical control device shown in the first realization variant is also realized as a mechanical control device 413 in the case of the fifth realization variant, a detecting device 413*a* not being realized by a pressure pin or pressure plunger but as a diaphragm pressure sensor 485 which actuates a valve device 413*b* of the control device 413 with its diaphragm 485*a*. As a result of using the diaphragm pressure sensor 485, the control device 413 is completely encapsulated in relation to the paint line 407 such that wear brought about by penetrating paint is prevented.

Figure 8:
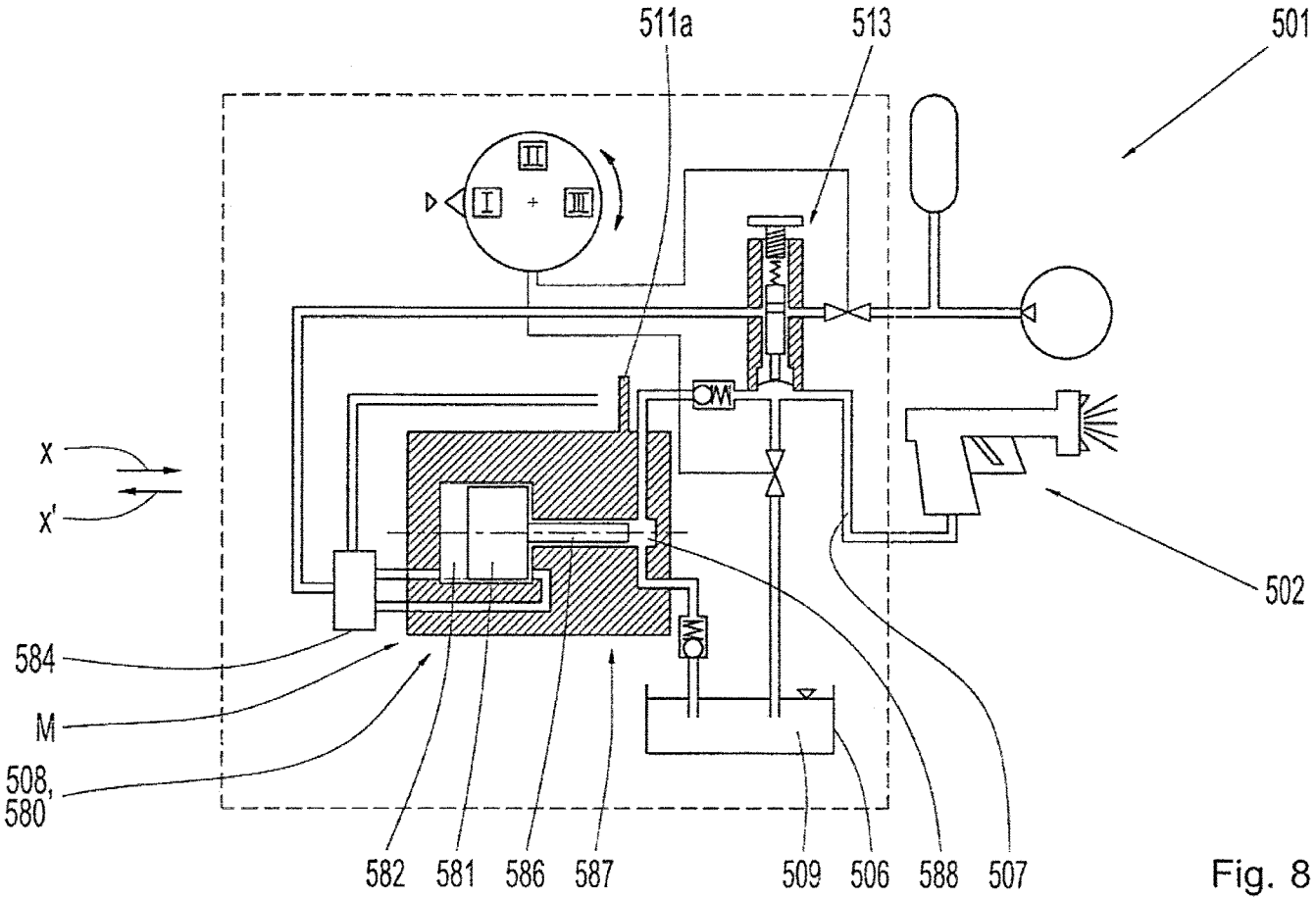
FIG. 8 shows a schematic representation of a sixth realization variant of a paint spraying unit according to the invention.

FIG. 8 shows a schematic representation of a sixth realization variant of a paint spraying unit 501 according to the present invention. Reference is made here, in principle, to the description relating to the first realization variant of a paint spraying unit shown in FIG. 1. In contrast to the first realization variant, a compressed air motor M which operates as a drive device 508 is not realized as a radial piston motor but as a compressed air linear motor 580. As a result of a two-way impingement of a piston 581 in a cylinder chamber 582 with compressed air, the piston 581 carries out a linear movement in the directions of the arrow x or x'. A second piston 586 is connected to the piston 581. The second piston 586 is a component part of a piston pump 587, by means of which paint 509 is pumped out of a paint container 506 into a paint line 507 in a manner that is conventional for piston pumps and as a result to a paint spraying device 502. The piston 586 of the piston pump 587 is shown in a position in which a cylinder chamber 588, which is located in front of the piston 589, is compressed to the maximum. A re-routing of a compressed air supply into the cylinder chamber 582 is effected by a re-routing unit 584 which operates, in particular, in dependence on a piston position and/or in dependence on a pressure build-up in the cylinder chamber 582. Compressed air conducted out of the cylinder chamber 582 is used on cooling ribs 511*a* for cooling the piston pump 587. With reference to the realization and function of a mechanical control device 513, reference is explicitly made to the statements relating to FIG. 7. With regard to the realization of the piston pump, it is also provided to use piston pumps with two and more pistons.

According to further realization variants which are not shown, proceeding from the realization variants shown and described, paint spraying units which comprise other combinations of motor type and pump type are also provided. Thus, for example, a paint spraying unit where the motor type of a vane motor is combined with the pump type of a piston pump is also provided.

LIST OF REFERENCES

1 Paint spraying unit
2 Paint spraying device
2*a* Spray head of 2
2*b* Extraction of 2
2*c* Paint nozzle of 2
3 Drive and supply unit
4 Compressed air source
5 Paint pump
5*a* Diaphragm of 5
5*b* First diaphragm chamber or oil chamber
5*c* First side of 5
5*d* Inflow line
5*e* Pressure relief line
5*f* Oil tank
5*g* Pressure relief valve
5*h* Second side of 5
5*i* Second diaphragm chamber of 5
5*j* Inflow line
5*k* Pressure relief line
5*m* Non-return valve
6 Paint storage container
7 Paint line
8 Drive device
9 Paint
10 Compressed air rotation motor
10*a* Motor block of 10
10*b*, 10*c* Piston
10*d*, 10 Connecting rod
10*f* Motor shaft
10*g* Compressed air distributing device
10*h* Cylinder chamber
10*i* Double eccentric
11 Piston diaphragm pump
11*a* Cooling ribs
11*b* Oil
11*c* Pump housing of 11
11*d* Pressure piston
11*e* Restoring spring
11*f* Piston surface
12 Compressed air supply valve
13 Control device
13*a* Detecting device
13*b* Valve device
13*c* Pressure preselecting device
14 Compressed air
15 Non-return valve
16 Paint pressure relief valve or paint pressure relieving valve
17 Plunger
18 Blocking element
19 Screen
20 Resilient pin
21 Threaded pin
22 Spring
23 Valve seat
23*a* Window
23*b* Through-bore
24 Compressed air line
25 Multi-switch
26 Rotary switch
80 Radial piston motor
101 Paint spraying unit
102 Paint spraying device
102*a* Spray head of 102
102*b* Extraction of 102
102*c* Paint nozzle of 102
102*d* Air nozzle of 102
102*e* Air nozzle of 102
102*f* Supply line to 102*d*, 102*e*
102*g* Control valve for 102*s*, 102*e*
103 Drive and supply unit
104 Compressed air source
201 Paint spraying unit
205 Paint pump
208 Drive device
210 Compressed air rotation motor
210*i* Double eccentric
211*d* Pressure piston
211 Piston diaphragm pump
213 Electromechanical control device
213*a* Detecting device
213*b* Valve device
213*c* Pressure selecting device
240 Pressure sensor
241 Electrically actuated valve
242 Storage unit
243 Evaluating device
250 Motor shaft of 280
251 Stator of 280
252 Cylindrical receiving chamber in 251
253 Air inlet opening of 251
254,255 Air outlet opening of 251
256 Radially arranged longitudinal slot on 250
257 Vane
258 Inner wall of 252
259 Chamber with modifiable volume
260 Rotor
280 Compressed air vane motor
301 Paint spraying unit
304 Compressed air source
305 Paint pump
308 Drive device
310 Compressed air rotation motor
310*a*, 310*b* Piston
310*d*, 310*e* Connecting rods
310*f* Motor shaft
311 Piston diaphragm pump
311*d* Pressure piston of 311
313*a* Detecting device
313*b* Valve device
313*c* Pressure preselecting device
361 Paint outlet
362 Paint inlet
363 Compressed air connection
364 Paint step
365 Oil step
366 Paint outlet valve
367 Paint pressure relief valve
368 Paint channel
369 Paint pressure actual value sensor
370 Resilient plunger of 369
371 Plunger
371*a* Plate of 371
371*b* Seal of 371
371*c* Sleeve
372 Channel
372*a* Shoulder in 372
372*b* Air inlet of 372
372*c* Air outlet of 372
373 Adjustable paint pressure required value valve
373*a* Spring of 373
374 Path through 313*b*

375 Valve of 313*b*
380 Radial piston motor
401 Paint spraying unit
405 Diaphragm pump
405*a* Diaphragm
406 Paint container
407 Paint line
408 Drive device
409 Paint
411*a* Cooling rib
413 Mechanical control device
413*a* Detecting device
413*b* Valve device
480 Compressed air linear motor
481 Piston
482 Cylinder chamber
483 Plunger
484 Re-routing unit
485 Diaphragm pressure sensor
485*a* Diaphragm
501 Paint spraying unit
502 Paint spraying device
506 Paint container
507 Paint line
508 Drive device
509 Paint
511*a* Cooling rib
580 Compressed air linear motor
581 Piston of 580
582 Cylinder chamber for 581
584 Re-routing unit
586 Piston of 587
587 Piston pump
588 Cylinder chamber for 586
A Outlet of 5
DL Compressed air outlet
E Inlet of 2
K Oil cooler
L313 Longitudinal axis of 370, 371 and 373*a*
M Motor
P7 Paint pressure
P207 Paint pressure P207
P307 Paint pressure in 368
R Controller
RE Regulating device
x, x' Direction of arrow
Z1, Z2 Cylinder of 80

The invention claimed is:

1. A paint spraying unit comprising a paint pump, a paint storage container, a paint spraying device, a paint line and a drive device, wherein the drive device drives the paint pump and wherein the paint pump conveys paint out of the paint storage container through the paint line to a paint nozzle of the paint spraying device, wherein the drive device includes a compressed air rotation motor as a motor wherein the paint spraying unit includes a control device that includes a detecting device, a valve device and a pressure preselecting device, wherein the detecting device detects a paint pressure of the paint in the paint line between an outlet of the paint pump and an inlet of the paint spraying device, wherein the valve device, in dependence on the detected paint pressure, determines a compressed air supply to the motor in such a manner that the compressed air supply reduces or is interrupted when the paint pressure is sufficient and that the compressed air supply is increased or opened if the paint pressure is too low, and wherein the pressure preselecting device gives a maximum value for the paint pressure from which the compressed air supply is reduced or interrupted, and gives a minimum value for the paint pressure from which the compressed air supply is increased or opened.

2. The paint spraying unit according to claim 1, wherein the compressed air rotation motor is one of a radial piston motor and a vane motor.

3. The paint spraying unit according to claim 1, wherein the control device is a mechanical control device, wherein the detecting device includes a plunger, wherein the valve device includes a blocking element, and wherein the pressure preselecting device includes a resilient pin.

4. The paint spraying unit according to claim 3, wherein the plunger of the detecting device is arranged so as to be displaceable in a valve seat of the control device and projects into the paint line, the resilient pin of the pressure preselecting device is arranged in the valve seat of the control device, wherein the blocking element of the valve device is clamped in the valve seat between the plunger and the pin, wherein, in dependence on a position of the plunger and pin, the blocking element closes or opens a compressed air line which crosses the valve seat of the control device.

5. The paint spraying unit according to claim 1, wherein the control device is an electromechanical control device, wherein the detecting device includes a pressure sensor, wherein the valve device includes an electrically actuated valve, wherein the pressure preselecting device includes a storage unit, and wherein the control device includes an evaluating device.

6. The paint spraying unit according to claim 5, wherein the pressure sensor outputs a signal value in dependence on a predominant paint pressure, a maximum value and a minimum value for the paint pressure is stored in the storage unit, and an actuating value for the valve is determined in the control device and forwarded to the valve, wherein the actuating value is determined in dependence on a signal value of the pressure sensor and in dependence on the stored maximum value and on the stored minimum value.

7. The paint spraying unit according to claim 1, wherein the compressed air rotation motor drives a piston diaphragm pump which generates a pulsating oil flow, wherein the oil flow pushes on a first side of a diaphragm of the paint pump which is a piston diaphragm pump and wherein, with a second side of the diaphragm, the piston diaphragm pump pumps liquid paint through the paint line to the paint spraying device.

8. The paint spraying unit according to claim 1, wherein the compressed air driving the motor cools the paint pump as exhaust air, wherein the motor includes a compressed air outlet, wherein the paint pump includes an oil cooler and wherein the compressed air outlet is connected to the oil cooler in such a manner or is aligned in such a manner with the oil cooler that the compressed air emerging out of the compressed air outlet contacts the oil cooler and cools the oil cooler.

9. The paint spraying unit according to claim 1, wherein the paint spraying unit includes a paint pressure relief valve for the paint line, wherein the paint pressure relief valve is connected in such a manner to a compressed air supply valve for a compressed air supply to the motor that the paint pressure relief valve relieves the paint line when the compressed air supply to the compressed air supply valve is blocked.

10. The paint spraying unit according to claim 9, wherein the paint pressure relief valve is further connected in such a manner to the compressed air supply valve for the compressed air supply to the motor that the compressed air supply valve for the compressed air supply is closed as a result of actuating the paint pressure relief valve.

11. The paint spraying unit according to claim 1, wherein the paint spraying unit includes a multi-switch, wherein in a first switching step of the multi-switch a compressed air supply valve is closed and a paint pressure relief valve is open, wherein in a second switching step of the multi-switch the compressed air supply valve is open and the paint pressure relief valve is open, and wherein in a third switching step of the multi-switch the compressed air supply valve is open and the paint pressure relief valve is closed.

12. The paint spraying unit according to claim 11, wherein the multi-switch is an infinitely rotatable switch such that it is possible to switch directly from the third switching step into the first switching step and from the first switching step into the third switching step avoiding a transient activation of the second switching step.

13. A paint spraying unit including a paint pump, a paint storage container, a paint spraying device, a paint line and a drive device, wherein the drive device drives the paint pump and wherein the paint pump conveys paint out of the paint storage container through the paint line to a paint nozzle of the paint spraying device, wherein the drive device includes a compressed air motor which is a pneumatic linear motor, the paint spraying unit includes a control device, wherein the control device includes a detecting device, a valve device and a pressure preselecting device, wherein the detecting device detects a paint pressure of the paint in the paint line between an outlet of the paint pump and an inlet of the paint spraying device, wherein the valve device, in dependence on the detected paint pressure, determines a compressed air supply to the motor in such a manner that the compressed air supply reduces or is interrupted when the paint pressure is sufficient and that the compressed air supply is increased or opened if the paint pressure is too low, and wherein the pressure preselecting device gives a maximum value for the paint pressure from which the compressed air supply is reduced or interrupted, and gives a minimum value for the paint pressure from which the compressed air supply is increased or opened.

14. The paint spraying unit according to claim 13, wherein the paint spraying unit includes a control device, wherein the control device includes a detecting device, a valve device and a pressure preselecting device, wherein the detecting device detects a paint pressure of the paint in the paint line between an outlet of the paint pump and an inlet of the paint spraying device, wherein the valve device, in dependence on the detected paint pressure, determines a compressed air supply to the motor in such a manner that the compressed air supply reduces or is interrupted when the paint pressure is sufficient and that the compressed air supply is increased or opened if the paint pressure is too low, and wherein the pressure preselecting device gives a maximum value for the paint pressure from which the compressed air supply is reduced or interrupted, and gives a minimum value for the paint pressure from which the compressed air supply is increased or opened.

15. The paint spraying unit according to claim 14, wherein the control device is a mechanical control device, wherein the detecting device includes a plunger, wherein the valve device includes a blocking element, and wherein the pressure preselecting device includes a resilient pin.

16. The paint spraying unit according to claim 15, wherein the plunger of the detecting device is arranged so as to be displaceable in a valve seat of the control device and projects into the paint line, the resilient pin of the pressure preselecting device is arranged in the valve seat of the control device, wherein the blocking element of the valve device is clamped in the valve seat between the plunger and the pin, wherein, in dependence on a position of the plunger and pin, the blocking element closes or opens a compressed air line which crosses the valve seat of the control device.

17. The paint spraying unit according to claim 14, wherein the control device is an electromechanical control device, wherein the detecting device includes a pressure sensor, wherein the valve device includes an electrically actuated valve, wherein the pressure preselecting device includes a storage unit, and wherein the control device includes an evaluating device.

18. The paint spraying unit according to claim 17, wherein the pressure sensor outputs a signal value in dependence on a predominant paint pressure, a maximum value and a minimum value for the paint pressure is stored in the storage unit, and an actuating value for the valve is determined in the control device and forwarded to the valve, wherein the actuating value is determined in dependence on a signal value of the pressure sensor and in dependence on the stored maximum value and on the stored minimum value.

19. The paint spraying unit according to claim 13, wherein the compressed air motor drives a piston diaphragm pump which generates a pulsating oil flow, wherein the oil flow pushes on a first side of a diaphragm of the paint pump which is a piston diaphragm pump and wherein, with a second side of the diaphragm, the piston diaphragm pump pumps liquid paint through the paint line to the paint spraying device.

20. The paint spraying unit according to claim 13, wherein the compressed air driving the motor cools the paint pump as exhaust air, wherein the motor includes a compressed air outlet, wherein the paint pump includes an oil cooler and wherein the compressed air outlet is connected to the oil cooler in such a manner or is aligned in such a manner with the oil cooler that the compressed air emerging out of the compressed air outlet contacts the oil cooler and cools the oil cooler.

21. The paint spraying unit according to claim 13, wherein the paint spraying unit includes a paint pressure relief valve for the paint line, wherein the paint pressure relief valve is connected in such a manner to a compressed air supply valve for a compressed air supply to the motor that the paint pressure relief valve relieves the paint line when the compressed air supply to the compressed air supply valve is blocked.

22. The paint spraying unit according to claim 21, wherein the paint pressure relief valve is further connected in such a manner to the compressed air supply valve for the compressed air supply to the motor that the compressed air supply valve for the compressed air supply is closed as a result of actuating the paint pressure relief valve.

23. The paint spraying unit according to claim 13, wherein the paint spraying unit includes a multi-switch, wherein in a first switching step of the multi-switch a compressed air supply valve is closed and a paint pressure relief valve is open, wherein in a second switching step of the multi-switch the compressed air supply valve is open and the paint pressure relief valve is open, and wherein in a third switching step of the multi-switch the compressed air supply valve is open and the paint pressure relief valve is closed.

24. The paint spraying unit according to claim 23, wherein the multi-switch is an infinitely rotatable switch such that it is possible to switch directly from the third switching step into the first switching step and from the first switching step into the third switching step avoiding a transient activation of the second switching step.

* * * * *